United States Patent [19]

Anderson et al.

[11] Patent Number: 4,744,445

[45] Date of Patent: May 17, 1988

[54] CASE ASSEMBLY KIT

[75] Inventors: Michael D. Anderson, 1004 Nard Rd., Encinitas, Calif. 92024; Mark A. Baumgart, Santee, Calif.

[73] Assignee: Michael D. Anderson, Encinitas, Calif.

[21] Appl. No.: 857,740

[22] Filed: Apr. 29, 1986

[51] Int. Cl.[4] ..... A45G 3/02; A45G 7/00

[52] U.S. Cl. ..... 190/107; 29/428; 190/37; 190/127; 292/Dig. 42; 220/84; 217/65

[58] Field of Search ..... 190/107, 900, 901, 119, 190/25, 37, 126, 127, 24; 220/84, 4 F; 217/65

[56] References Cited

U.S. PATENT DOCUMENTS

| | | | |
|---|---|---|---|
| 45,251 | 1/1914 | Chodorkow et al. | 190/127 X |
| 181,738 | 8/1876 | Soule et al. | 190/25 |
| 294,209 | 8/1908 | Smith | 220/84 |
| 466,966 | 1/1892 | Roemer | 190/126 |
| 1,372,274 | 3/1921 | Calkin | 190/126 |
| 2,347,192 | 4/1944 | Grice | 190/37 X |
| 2,392,734 | 1/1946 | Haberstump | 190/37 UX |
| 2,578,644 | 12/1951 | Mautner | 220/84 |
| 2,590,159 | 3/1952 | Davis | 217/65 |
| 2,655,882 | 10/1953 | Tripp | 220/84 |
| 2,717,093 | 9/1953 | Mautner | 217/65 |
| 2,956,705 | 10/1960 | Clingman | 217/65 |
| 2,980,285 | 4/1961 | Parsons | 220/84 |
| 3,517,849 | 6/1970 | Presnick | 220/84 |
| 3,938,630 | 2/1976 | March | 190/24 |
| 3,989,157 | 11/1976 | Veneema | 220/84 |
| 4,448,292 | 5/1984 | Comfort | 220/4 F |
| 4,509,622 | 4/1985 | Morszeck | 190/119 |

FOREIGN PATENT DOCUMENTS

| | | | |
|---|---|---|---|
| 803929 | 4/1951 | Fed. Rep. of Germany | 190/127 |
| 814,321 | 9/1951 | Fed. Rep. of Germany | 190/24 |
| 1457352 | 3/1969 | Fed. Rep. of Germany | 190/127 |
| 901362 | 11/1944 | France | 190/24 |
| 24086 | of 1908 | United Kingdom | 190/107 |
| 142251 | 5/1920 | United Kingdom | 190/127 |

*Primary Examiner*—William Price

*Attorney, Agent, or Firm*—Brown, Martin, Haller & Meador

[57] ABSTRACT

A case assembly kit for assembling a case of any chosen dimensions from a plurality of separate components includes a series of panels which are cut to chosen dimensions to form the bottom, side and end walls of a box-like, open top enclosure base and the top, side and end walls of a similar box-like lid. The kit further includes a series of angled corner strips for connecting adjacent edges of the bottom, side and end wall panels of the base and top, side and end wall panels of the lid, and mateable closure strips for securing along the opposed peripheral upper and lower edges, respectively, of the base and lid. Hinge devices are provided for hinging the lid along one edge to the base, and a latching mechanism is provided for releasably closing the lid. All the separate parts are securable together by bonding.

16 Claims, 3 Drawing Sheets

CASE ASSEMBLY KIT

BACKGROUND OF THE INVENTION

The present invention relates generally to cases and the like and to methods of making cases, and is particularly directed to a kit of separate components for assembling cases.

Cases are made for a wide variety of applications including transportation, shipping and storage and are required in a wide variety of shapes and sizes. Up to now such cases have normally only been available in ready-made or made-to-order format, with ready-made cases of any particular type normally only being available in a standard range of sizes. Made-to-order cases are relatively expensive and are not readily available in the manner of an off the shelf item.

Standard cases, containers and the like are normally manufactured of panels of various materials suitably riveted or bolted together to form an enclosure. For example, U.S. Pat. No. 2,717,093 of Mautner shows a shipping case built up of panels held in metal frame members. In U.S. Pat. No. 3,517,849 of Presnick a collapsible shipping container is described which is formed from framing rails defining a closed frame for holding paneling.

SUMMARY OF THE INVENTION

According to the present invention an assembly kit for assembling a case having a base and a lid from a series of separate parts is provided, the kit allowing cases of any chosen dimensions to be made. The assembly kit basically comprises a series of panels of any chosen dimensions for forming the bottom, side and end walls of an open topped box-like enclosure base, and similar panels for forming a lid for closing the open top of the base, a series of angled corner strips for connecting adjacent edges of the panels together along the longitudinal and side edges of the base and lid to form the box-like enclosures, a hinge mechanism for hinging the lid to the base, and a latch mechanism for releasably closing the lid. Preferably, the kit also includes mateable or co-operable edge strips for securing around the open upper end of the base and lower edge of the lid, respectively, for mating engagement with one another when the lid is closed to restrict movement of the lid relative to the base. Also provided in the preferred embodiment are corner pieces for securing at the lower four corners of the base and the upper four corners of the lid. Metable corner pieces may be provided which are of similar configuration to the mateable edge strips for securing to the upper and lower corner edges, respectively, of the base and lid.

Preferably, all the parts or components of the kit are of plastics material and are secured to one another by bonding. The panels, angled corner strips and edge strips may be provided in standard sizes and lengths for cutting to size by the purchaser, or may be provided in pre-cut dimensions for assembling of predetermined size cases by the purchaser.

With this kit cases can be quickly, inexpensively and easily assembled in an unlimited range of sizes, simply by appropriate choice of the dimensions of the panels, corner and edge strips before bonding the various parts together. The lid and base are preferably of similar box-like format, and may be of the same or different depths as desired.

According to another aspect of the invention a method of assembling a case of any chosen length, width and height from a kit of parts is provided, which comprises the steps of:

cutting a series of panels to predetermined dimensions to form the bottom, side and end walls of a box-like base and top, side and end walls of a box-like lid for the case;

bond corner angle strips along the adjacent edges of the side and end walls of the base and lid, respectively, to form a box-like rectangular enclosure, and along the adjacent edges of the bottom wall and adjacent lower edges of the side and end walls, and the edges of the upper wall and adjacent upper edges of the side and end walls of the lid, respectively to form right angle joints between the respective panels and provide two separate box-like enclosures;

bond closure strips having a first mateable formation along at least part of the open edge of one of the formed enclosures and bond closure strips having a second formation mateable with the first along at least part of the open edge of the other formed enclosure;

bond a two part hinge mechanism to the base and lid enclosure, respectively, to form a hinge connection between the lid and base; and bond a first part of a latch mechanism to the lid and a second part of a latch mechanism to the base, the two parts being releasably connectable together to releasably secure the lid to the base in its closed position.

The kit assembly may also include a carrying handle which may be bonded or otherwise secured to the assembled case, feet members or pads for securing to the bottom of the case, and one or more cover stops for securing to the inside of the case to hold the lid or cover partially or completely open. The hinge mechanism may comprise one or more hinges each formed from two separable hinge parts which are preferably only separable in one particular orientation of the two hinge parts to prevent the lid from becoming accidentally separated from the base.

BRIEF DESCRIPTION OF THE DRAWINGS

The present invention will be better understood from the following detailed description of a preferred embodiment, taken in conjunction with the accompanying drawings in which like reference numerals refer to like parts and in which.

DESCRIPTION OF THE PREFERRED EMBODIMENT

Figure 1:
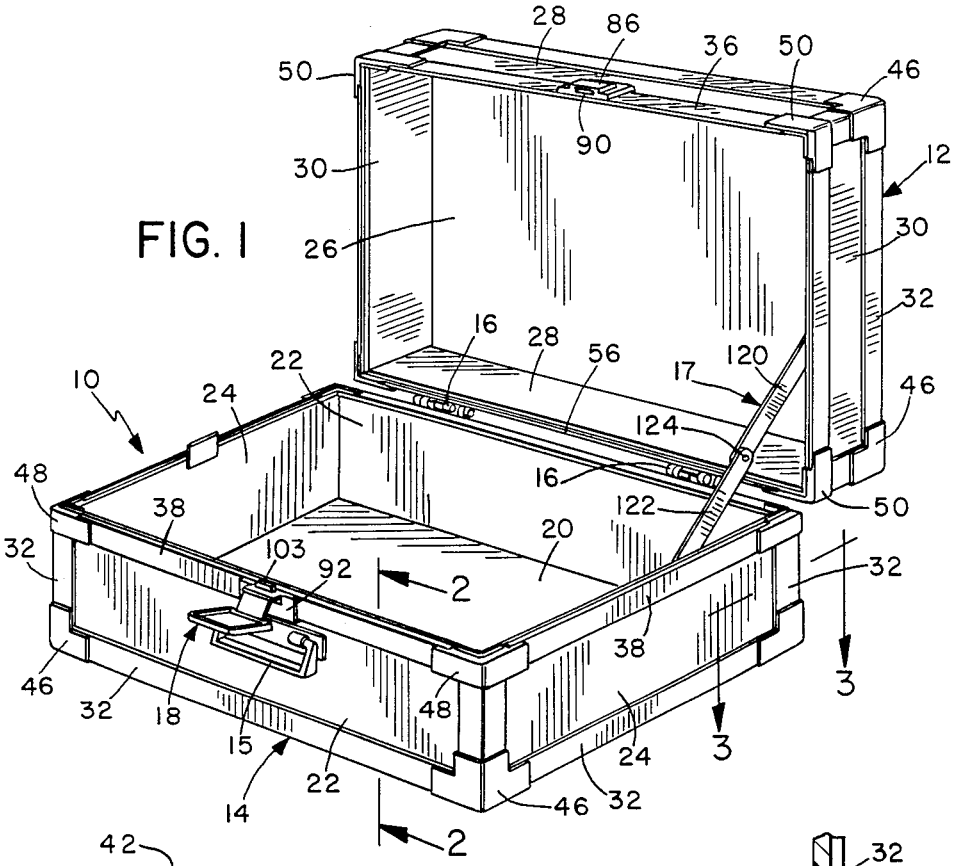
FIG. 1 is a perspective view of a typical case constructed according to the present invention.

FIG. 1 of the drawings shows a preferred embodiment of a case 10 which can be assembled from a kit of separate components as illustrated in the remaining drawings. The case can be designed to have any chosen length, width and height dimensions. The assembled case basically comprises upper and lower box-like enclosures comprising the lid 12 and base 14 of the case, the lid being hinged along one edge to the base by hinge devices 16. A two part latch mechanism 18 is provided for releasably securing the lid to the base along the opposite edge to the hinges. Preferably, the case is also provided with a carrying handle 15 and cover or lid stops 17, one of which is illustrated in FIG. 1. In the preferred embodiment a second lid stop is secured to the other end of the case in an equivalent manner.

The separate components of the case are preferably all securable together by bonding, as described in more detail below, and are therefore preferably all made from a bondable plastics material which can be bonded with a suitable bonding agent which softens contacting plastic faces and allows two pieces to weld together to form a strong joint.

The assembly of the case will now be described in more detail with reference to the drawings. The lid and base are each of box-like configuration and are each made up of five separate panel sections, the base being formed from a bottom wall panel 20, and side and end wall panels 22, 24, respectively, and the lid being formed of a top wall panel 26 and side and end wall panels 28, 30, respectively. The top and bottom wall panels are of the same length and width while the side and end wall panels are each of the same length but may be of different heights, for example so that the base is deeper than the lid as shown in the drawings. Thus the person assembling the case, given the desired internal dimensions, can cut out ten panels of the appropriate dimensions to form the base and lid walls 20, 22, 24, 26, 28 and 30.

The two box-like enclosures forming the base and lid of the case are then assembled using angled corner strips 32. The corner strips are elongate, right angled corner sections which are cut to appropriate lengths to connect adjacent edges of the wall panels together along the corner edges between the side and end walls and between the top or bottom wall, respectively, and the adjacent edges of the side and end walls.

Figure 2:
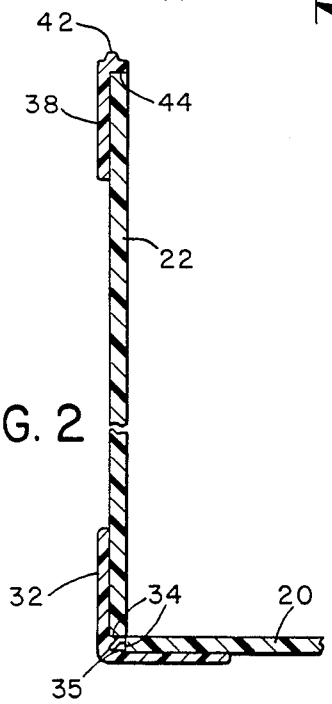
FIG. 2 is an enlarged sectional view taken on line 2—2 of FIG. 1.
Figure 3:
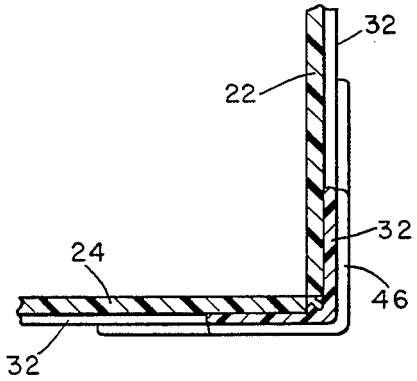
FIG. 3 is an enlarged sectional view taken on line 3—3 of FIG. 1.

The joints between the side and end walls of the base and lid are first formed. Four lengths each of corner strip corresponding to the height of the base and lid, respectively, are first cut. The corner strip is best shown in FIGS. 2 and 3 and comprises a right angle joint having internal stop ridges 34. The appropriate panel edges are placed tight against the inner faces of the corner strip with the appropriate edge 35 of each panel located against the appropriate stop ridge 34. The contacting faces of the panels and corner strip are suitably bonded together to secure any two adjacent wall panels together at a right angle. In both the base and lid, the side and end walls are all connected together in this fashion to form an open ended rectangular enclosure and the length of corner strip at each of the four corners is therefore substantially equal to the height of the respective enclosure. The bottom and top wall panels are then connected to close one open end of each enclosure by connecting their perimeter edges to the abutting edges of the side and end walls by bonding adjacent edges of the panels to appropriate lengths of the corner strip in an equivalent manner. The corner strips connecting the side and end walls to the bottom and top wall panels, respectively, extend between the corner strips connecting the side and end wall panels and abut against the edges of these strips without overlapping, as indicated in the drawings. Thus the lengths of corner strip required to connect the bottom panel of the base to the side and end walls and the top panel of the lid to the side and end walls comprise four strips of lengths equal to the length of the case minus twice the width of one limb of the corner strip, and four strips of lengths equal to the width of the case minus twice the width of one limb of the corner strip.

Figure 4:
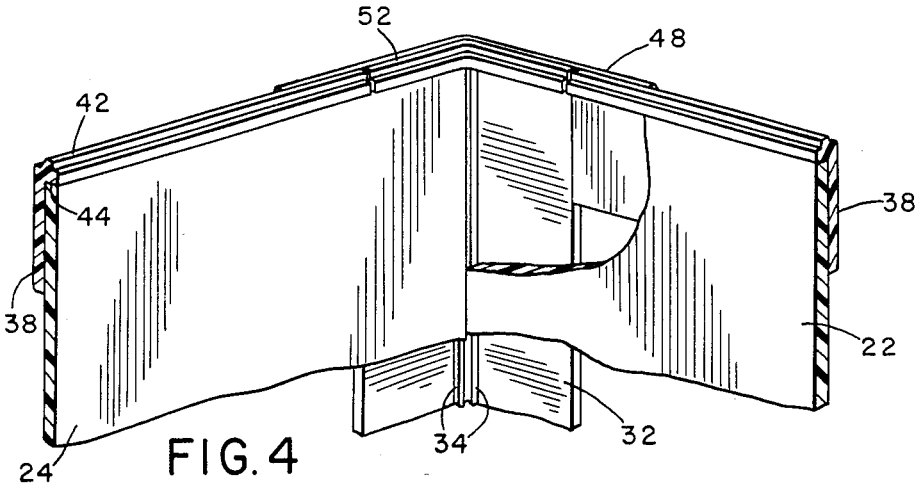
FIG. 4 is an inside cut away perspective view of an upper corner of the lower case portion.
Figure 8:
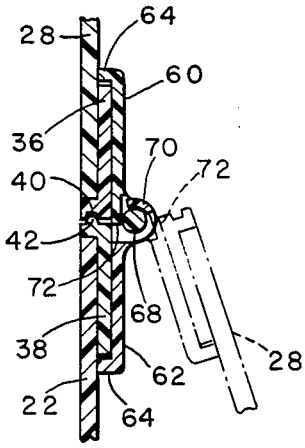
FIG. 8 is a sectional view taken on line 8—8 of FIG. 7.

Mateable closure strips 36 and 38, respectively, are then secured along the open upper edge of the base and lower edge of the lid, respectively, as best shown in FIGS. 2,4 and 8. The closure strips have cooperable mating formations for ensuring the lid is located correctly on the base when closed and prevented from movement relative to the base. In the preferred arrangement shown the strips are in two types, one of which has a groove 40 along one edge and the other of which has a tongue 42 along one edge for fitting in the groove. In the arrangement shown in the drawings the grooved strip 36 is connected along the periphery of the lid while the tongue strip 38 is connected along the open upper edge of the base, but clearly the two strips could be reversed in alternative embodiments. The lengths of closure strip extend between but stop short of the corner sections of the peripheral edges of the base and lid, as can be seen in FIG. 1 and 4. Thus the strips abut against the edges of the corner strips, and the lengths of closure strip required can be calculated according to the corner strip dimensions as described above for connecting the bottom panel of the base and the top panel of the lid.

The closure strips are suitably bonded to outer face portions of the side and end panels of the enclosures defining the base and lid adjacent the open peripheral edges of those enclosures, with the cooperating formations facing outwardly towards one another as shown in FIG. 1. The closure strips are preferably provided with overlapping edges or rims 44 for locating them against the panel edges in the correct position, as shown in the drawings.

Figure 12:
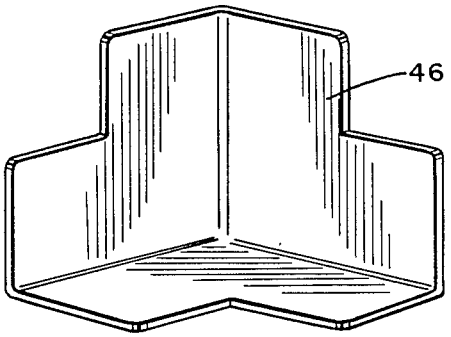
FIG. 12 is an inside perspective view of the inside corner piece used on both upper and lower case portions.

Both the base and the lid are provided with four three way corner reinforcement members 46, for reinforcing the four lower corners of the base and upper four corners of the lid as best seen in FIG. 1 and 3. One of the corner members is shown in more detail in FIG. 12. The three way corners are bonded over the respective corners after the box-like enclosures have been formed.

Figure 5:
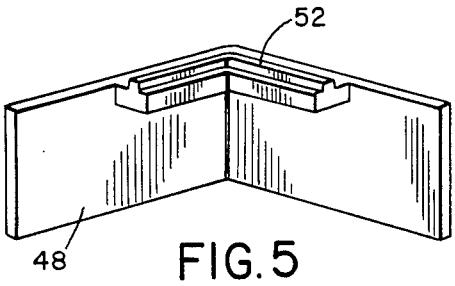
FIG. 5 is an inside perspective view of the outer corner piece used in FIG. 4.
Figure 6:
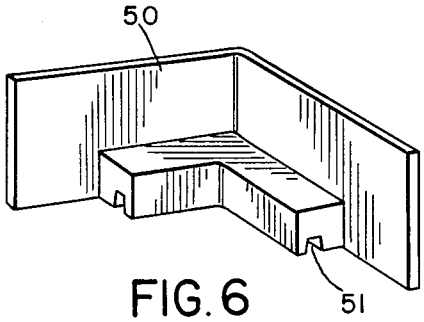
FIG. 6 is an inside perspective view of the outer corner piece of the lower edge of the upper case portion.

The base is provided with four two way closure corners 48 having a similar mateable formation to the closure strip secured to the upper edge of the base, and the lid is provided with four similar closure corners 50 having a cooperating formation. Thus, in the illustrated embodiment, the closure corners 48 each comprise an angle piece having an upwardly directed tongue or ridge 52 at the corner area, as shown in FIG. 5, while the closure corners 50 each comprise an angle piece having a downwardly directed groove 51 in the corner area as shown in FIG. 6 for receiving the tongue on angle piece 48. The closure corners are suitably bonded to respective corners of the open ends of the enclosures defining the base and lid, as indicated in FIG. 4. When assembled, the respective tongue and groove of the corner pieces are continuous with the respective adjacent tongues and grooves of the closure strips, as seen in FIG. 4.

In the preferred embodiment of the invention described above all the components so far mentioned are of bondable plastics material which may be bonded together with a suitable solvent bonding agent such as Butanone or the like which acts to soften the underlying plastic and allows any two pieces to which it is applied to weld together on hardening. Thus no additional securing devices such as bolts or rivets are required to secure the case parts together, making assembly much faster and simpler to accomplish.

In the preferred embodiment the basic case assembly kit comprises one or more sheets of plastics material of appropriate dimensions for cutting into the base and lid wall panels, such as ⅛" ABS panel sheets, for example, appropriate lengths of corner strip for forming the joints between the respective panels making up the base and lid enclosures, appropriate lengths of the two types of closure strip for securing around the periphery of the base and lid, as well as eight three way corners and four each of the two types of closure corners, and a suitable bonding agent for bonding these components together to assemble the base and lid. Also provided are one or more hinge devices 16 and a latch mechanism as described in more detail below with reference to FIGS. 7 to 11.

All of these kit components may be of the same type of bondable plastics material, or of different plastics materials, suitable materials being ABS or polycarbonate material, or equivalents, for example, the strips being extruded and the smaller individual components being molded. Since the plastic components can be assembled together using a common bonding agent, no drilling, riveting or screwing together of parts is required, making construction much faster and easier. Also, since the panels and connecting strips are individually cut to the required size, either by the supplier or end user, rather than using standard size, ready made components, a much larger range of case sizes can be provided quickly and easily, and much less expensively than previously for custom sized cases.

Once the base and lid enclosures have been assembled as described above, the lid is suitably hinged to the base along one edge which becomes the rear edge 56 of the assembled case. The hinge device in the preferred embodiment is a two part releasable hinge as shown in more detail in FIGS. 7 and 8. The hinge device may alternatively be nonreleasable, but a releasable hinge construction allows the lid to be completely removed from the base which is useful in some applications, for example when an article is sometimes used while still in the case, such as a personal computer, for example. In the embodiment shown in FIG. 1 two hinge devices are used, but a greater or lesser number of hinge devices may be used in alternative embodiments according to the overall dimensions of the case.

The hinge parts are suitably of a similar bondable plastics material to the other case components, for example ABS or polycarbonate plastics material. In the preferred embodiment the two parts of each releasable hinge device are separable only in one relative orientation of the parts, which in the assembled case corresponds to fully opening and bending back the lid. This helps to avoid accidental separation of the hinge.

Figure 7:
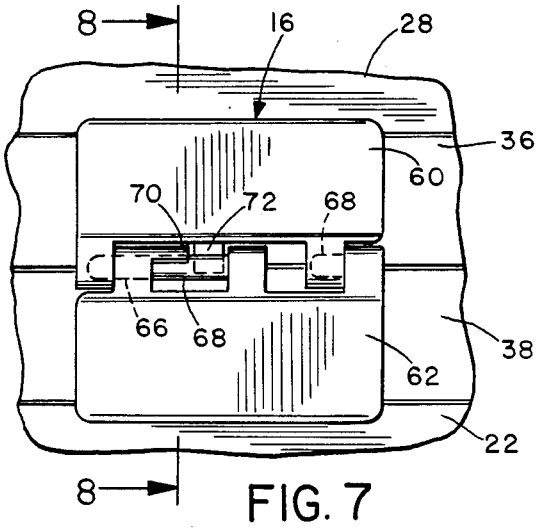
FIG. 7 is a rear elevation view of a hinge assembly.

As shown in FIG. 7 and 8, the two parts 60 and 62 of the hinge each are plate like members for bonding against the respective outer faces of the base and lid at the rear edge of the case, the members having a lip or rim 64 along one edge for locating them against the inner edge of the respective closure strip, as seen in FIG. 8. Co-operable hinge formations are provided along the opposite edges of the parts and face outwardly from the rear walls of the base and lid when the parts are bonded in place. As shown, the hinge part 60 has spaced bores 66 adjacent each end of the hinge edge while the other hinge part 62 has spaced pins 68 for rotatable engagement in the respective bores 66. Co-operating tangs or stops 70, 72 are provided on the two hinge parts between the pins and bores, which prevent relative axial movement along the pivot axis to release the pins from the bores unless part 60 is rotated relative to part 62 so that tang 70 is out of alignment with tang 72 to allow the parts to be slid axially apart (to the right in FIG. 7) to release the pins from the bores. This orientation corresponds to the lid being fully opened and bent back as far as possible, as indicated in dotted outline in FIG. 8. This substantially reduces the risk of the lid being accidentally separated from the base. The separable arrangement allows the lid to be removed from the base if necessary. Although in the preferred embodiment a separable hinge mechanism is used, alternative hinge mechanisms including fixed hinges may be used in other embodiments of the invention.

Figure 9:
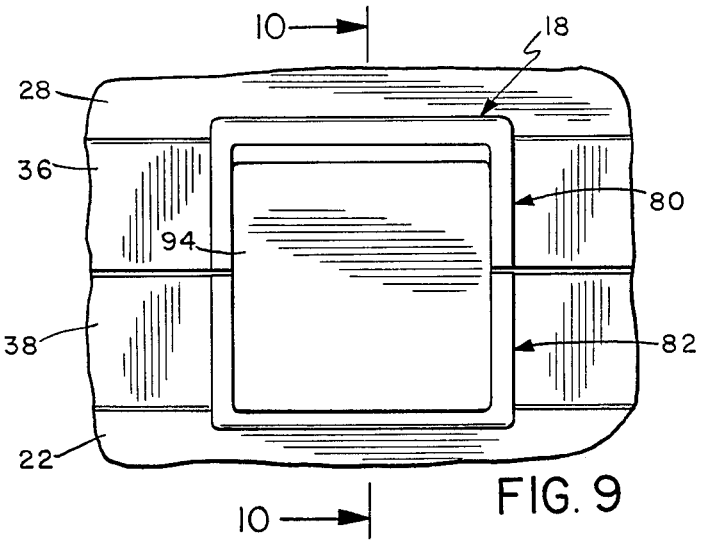
FIG. 9 is a front elevation view of the latch in closed position.
Figure 10:
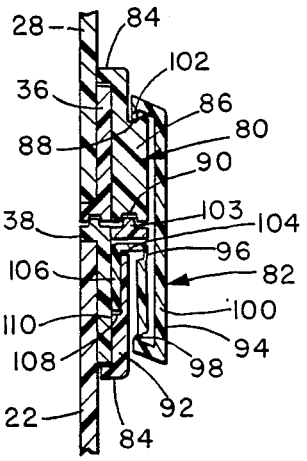
FIG. 10 is a sectional view taken on line 10—10 of FIG. 9.
Figure 11:
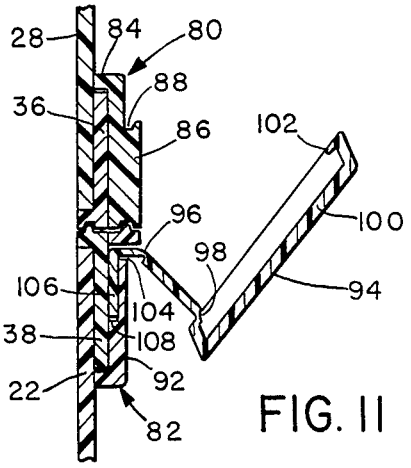
FIG. 11 is a sectional view similar to FIG. 10, but with the latch open.

A latch mechanism of any suitable form is suitably secured to the opposite edges of the lid and base to the hinge mechanism, i.e. to the front edge of the case. A preferred embodiment of the latch mechanism is shown in FIGS. 9 to 11, although alternative latch mechanisms may be used in other embodiments. As shown in FIGS. 10 and 11, the latch mechanism comprises two basic parts 80 and 82, one of which is secured to the lower front edge of the lid and the other of which is secured to the upper front edge of the base. The parts are suitably bonded to the closure strip at the front edge of the lid and base in the same manner as the hinge plates, and are of equivalent plate-like form with rims 84 for locating them against the inner edges of the closure strips as shown in FIGS. 10 and 11. The latch parts are suitably of bondable plastics material which can be bonded with the same bonding agent used for securing the other components of the assembly as described above.

In the preferred arrangement the first part 80 of the latch comprises a catch plate 86 having an upwardly directed locking groove 88 and a downwardly directed locking groove 90.

The second part of the latch is a two part assembly comprising a face plate 92 for securing to the closure strip on the front edge of the base, and an over-center clasp or latch handle 94 hinged along line 96 to the face plate. The clasp 94 has two portions hinged along line 98 to allow it to pivot up over catch plate 86, with the outermost portion comprising a plate like clasp member 100 having an indented area 101 with downwardly directed rim or edge 102 for locking engagement in groove 88 in the catch plate when in the clasped position shown in FIG. 10.

The face plate 92 has a tongue 103 which engages in groove 90 in the catch plate when the lid is closed. The clasp 94 is then pivoted upwardly as indicated in FIG. 11 and over the catch plate 86 to allow the rim 102 to engage in groove 88, after which the latch plate 100 is pivoted back down flat against the latch to retain the tongue 90 in groove 88. Clearly the tongue and groove could be reversed in alternative arrangements. The two hinges are preferably hinges of the so-called "living hinge" type, comprising thinner, bendable portions of the same material making up the clasp as indicated in FIGS. 10 and 11. Since plastics material suitable for forming living hinges is not normally bondable in the manner described above, the face plate is formed separately from the clasp and comprises means for bonding to the base and for trapping the clasp in place when bonded. In the preferred embodiment shown the face plate has a slot 104 for receiving projecting end portion 106 of the clasp, and has an indent or recess 108 on its inner face 110 in which portion 106 is recessed prior to bonding face 110 to the closure strip, thus trapping the clasp 94 on the face plate. The face plate may be of a similar bondable plastics material to the other molded components of the case, such as polycarbonate or the like, while the clasp is suitably of polypropylene or the like which is strong enough to produce a living hinge. In an alternative embodiment, the end portion 106 projects upwardly rather than downwardly as shown in the drawings, and the upper end of the portion 106 mates with slot 90 rather than tongue 103, which is omitted in this alternative.

The kit and assembly technique described above can be used to assemble a case of any desired dimensions quickly and easily. The wall panels, edge and closure strips may be cut to size with appropriate calculations according to the desired case internal dimensions, and this may be done either by the end user in a do-it-yourself fashion or by the supplier according to dimensions supplied by the user. A suitable instructions sheet may be provided with the assembly kit to aid in the assembly. Using this kit rapid constructions of cases having any chosen internal dimensions is possible, for example from as little as 4.5 inches deep by 2.75 inches wide by 4.75 inches long to 48 inches deep by 24 inches wide by 48 inches long or even longer using larger size initial sheets.

For example, if a case having overall internal dimensions of 18 inches by 12 inches wide by 6 inches deep is required, top and bottom panels of 18 inches by 12 inches will be cut. If the lid is to be 2.5 inches deep while the base is 3.5 inches deep, lid side panels of 18 inches by 2.5 inches and base side panels of 18 inches by 3.5 inches are cut. Lid end panels will be of 12 by 2.5 inches and base end panels will be of 12 by 3.5 inches. In fact because of the tongue and groove connection between the lid and base, the correct height is achieved by reducing the depth dimensions slightly, with the height of the base side and end panels being approximately $3\frac{3}{8}$ inches and the height of the lid side and end panels being approximately 2.25 inches. Four lengths of corner strip each equal to 2.25 inches, $3\frac{3}{8}$ inches, 10.75 inches, and 16.75 inches will be required, as well as two lengths each of tongue and groove closure strip equal to 10.75 inches, and two lengths each of tongue and groove closure strip equal to 16.75 inches.

Other optional components of the kit assembly of the invention shown in the drawings include the handle 15 and one or a pair of cover or lid stops 17 for holding the lid in the open position. The lid stop preferably comprises two arms 120, 122, one of which is hinged to the lid and the other of which is hinged to the base. The arms are pivoted together by means of pivot pin 124. The lid stop is preferably of a similar plastics material to the other components of the case and is bonded to the inner panel faces of the base and lid, respectively, in a similar fashion.

The handle 15 may also be of a bondable plastics material and be bonded in place. However, if the item or items to be carried in the case are relatively heavy, it may be screwed in place on the base for added strength and security.

Other optional components of the case, not illustrated in the drawings, include internal liners of wood or the like for lining the case for added rigidity, plastic feet for bonding to the bottom and/or rear wall of the case to protect the exterior walls against scratching when the case is placed on its bottom or rear wall, and padlocks and shipping strap guides. These are not provided in the basic kit but are supplied as optional extras where necessary.

The case assembly kit described above therefore allows a wide variety of cases of various shapes and sizes to be made quickly and easily according to an end user's precise specifications. Thus the user can obtain a case which effectively custom fits his requirements for an article or articles to be carried by the case, simply by working out the various wall panel sizes and connecting strip lengths and then ordering an appropriate kit, which may include precut panels and strips of sheets of panel material and lengths of strip for cutting by the end user. Up to now cases have only been readily and inexpensively available in a fairly limited range of sizes, requiring expensive special ordering of custom fit cases, whereas the kit of this invention allows a case of any length, width and depth dimensions to be made quickly and inexpensively. The bondable construction of the case components substantially simplifies construction over previous cases involving metal frames and the like which had to be secured together by riveting, bolts or screws.

Thus, the assembly kit allows assembly of relatively strong protective and/or decorative cases in a wide range of sizes from very small to very large and for a wide variety of applications. Any relative dimensions of length, breadth and depth may be chosen between minimum and maximum dimensions. The case can be suitably designed for carrying all types of items, from tools and electronic instruments to camera equipment, telescopes, paintings, sculptures and so on. The case may easily be fitted with internal dividing walls, cushioning pads, or the like where necessary. All that is needed to assemble the basic case is a kit, a knife and a ruler. Since common components are used for all cases, from very small to very large, a single user can keep basic components in stock for use when a further case of the same or different size is needed.

Although a preferred embodiment of the invention has been described above by way of example, it will be understood by those skilled in the field that modifications may be made to the disclosed embodiment without departing from the scope of the invention, which is defined by the appended claims.

We claim:

1. A case assembled from a kit, the case comprising: two box-like enclosures forming a base and lid of a case, the base and lid being hinged together along their rear edges and having a releasable latch mechanism for releasably securing the lid to the base at the front edge in a closed position;

mateable closure strips bonded around at least part of the peripheral edges of the base and lid, the closure strips having cooperable mating formations for mating engagement when the lid is closed on the base; and mateable two-way corner strips bonded to each corner on the peripheral upper and lower edges, respectively, of the base and lid, the corner strips having cooperable mating formations equivalent to those of the closure strips for mating engagement when the lid is closed on the base.

2. The case as claimed in claim 1, wherein the closure strips terminate at a distance from each corner, and the corner strips comprise angle members extending around the outer face of each corner, the angle members having inwardly projecting flanges having cooperable mating formations equivalent to those of the closure strips which extend up to the edge of the closure strips adjacent each corner and are aligned with the corresponding mating formations of the adjacent corner strips.

3. A case assembly kit for assembling a case of any chosen dimensions from a series of separate components, the components comprising:

a series of panel members of chosen dimensions for forming a case lid and the bottom, opposite side and end walls of box-like case having an open top;

hinge means for hinging the lid at one edge of the open top of the base;

latch means for releasably securing the opposite edge of the lid to the base in the closed position, the latch means comprising a first part for securing to the lid and a second part for securing to the base, one of the parts comprising a catch plate and the other part comprising clasp means for releasably securing to the catch plate, the clasp means comprising a face plate, the face plate and catch plate having cooperable mating formations for mating engagement when the lid is closed, and a clasp plate pivotally secured to the face plate for releasably securing the face and catch plate together, the clasp plate being pivotable between a first, released position and a second, clasped position in which it is retained on the catch plate;

a series of lengths of angled corner strip for connecting adjacent edges of the side and end walls, bottom and side walls, and bottom and end walls of the base to form right angled corner joints along the longitudinal and side edges of the base; and securing means for securing the components together to assemble the case.

4. A case assembly kit for assembling a case of any chosen dimensions from a series of separate components, the components comprising:

a series of panel members of chosen dimensions for forming top, opposite side and end walls of a box-like case lid and bottom, opposite side and end walls of a box-like case base having an open top;

hinge means for hinging the lid at one edge of the open top of the base;

latch means for releasably securing the opposite edge of the lid to the base in the closed position;

a series of lengths of angled corner strip for connecting adjacent edges of the side and end walls, bottom and side walls, and bottom and end walls of the base to form right angled corner joints along the longitudinal and side edges of the base, and for connecting adjacent edges of the side and end walls, top and side walls, and top and end walls of the lid, each corner strip comprising an elongate flat strip of bondable plastics material bent along its center line to form a right angled joint with inner flat faces for placing in face to face engagement with the outer faces adjacent the edges of two perpendicular abutting walls of the base and lid adjacent their abutting edges;

bonding means for bonding the inner flat faces of the angled corner strips to the outer face of portions of the side and end walls, bottom and side walls, and bottom and end walls of the base adjacent their abutting edges to assemble the base and lid;

mateable closure strips for securing around at least part of the open peripheral edges of the lid and base panels, the closure strips having co-operable mating formations for mating engagement when the lid is closed on the base; and four two-way closure corners having a first type of mateable formation corresponding to the formation on one of the closure strips and four two-way closure corners having a second type of mateable formation corresponding to the formation on the other closure strip, for securing the respective four corners of the open ends of the base and lid, respectively.

5. A case assembly kit for assembling a case of any chosen dimensions from a series of separate components, the components comprising:

a series of panel members of chosen dimensions for forming a case lid, and bottom, opposite side and end walls of a box-like case base having an open top;

hinge means for hinging the lid at one edge of the open top of the base;

latch means for releasably securing the opposite edge of the lid to the base in the closed position, said latch means comprising two parts, one for securing to the lid and the other for securing to the base, one of the parts comprising a catch plate and the other part comprising clasp means for releasably securing the catch plate wherein the clasp means comprises a face plate of bondable plastics material, the face plate and catch plate having co-operable mating formations for mating engagement when the lid is closed, and a clasp plate pivotally secured to the face plate for releasably securing the face and catch plate together, the clasp plate being pivotable between a first, released position and a second, clasped position in which it is retained on the catch plate;

a series of lengths of angled corner strip for connecting adjacent edges of the side and end walls, bottom and side walls, and bottom and end walls of the base to form right angled corner joints along the longitudinal and side edges of the base, each corner strip comprising an elongated flat strip of bondable plastics material bent along its center line to form a right angled joint with inner flat faces for placing in face to face engagement with the outer faces adjacent the edges of two perpendicular abutting walls adjacent their abutting edges; and bonding means for bonding the inner flat faces of the angled corner strips to the outer face of portions of the side and end walls, bottom and side walls, and bottom and end walls of the base adjacent their abutting edges to assemble the case base.

6. The kit as claimed in claim 4, wherein the components are at least partially of bondable plastics material and the bonding means comprises a plastics bonding agent for bonding the components together.

7. The kit as claimed in claim 4, wherein the closure strips comprise a first type of strip having a groove along one edge and a second type of strip having a tongue along one edge for mating engagement in the groove, one of the types comprising means for securing around at least part of the open peripheral edge of the base and the other type comprising means for securing around the open peripheral edge of the lid.

8. The kit as claimed in claim 4, wherein the series of panel members are of cut sheet material.

9. The kit as claimed in claim 8, wherein the panel members comprise sheet material of standard size sheets for cutting to any chosen panel dimensions.

10. The kit as claimed in claim 4, wherein the corner strips are strips cut from a continuous length of corner strip.

11. The kit as claimed in claim 4, wherein the cooperable closure strips are supplied in continuous lengths for cutting to the appropriate length for the assembled case.

12. The kit as claimed in claim 4, including four three way corner members for securing over the lower four corners of the base.

13. The kit as claimed in claim 4, including eight identical three way corner members for securing over the upper four corners of the lid and the lower four corners of the base.

14. The kit as claimed in claim 4, wherein the hinge means comprises at least one hinge device having two parts, one for securing to the lid and the other for securing to the base.

15. The kit as claimed in claim 14, wherein the hinge parts are releasable.

16. The kit as claimed in claim 5, wherein the clasp plate incorporates a living hinge.

* * * * *